US009540714B2

(12) United States Patent
Holcomb et al.

(10) Patent No.: US 9,540,714 B2
(45) Date of Patent: Jan. 10, 2017

(54) HIGH STRENGTH ALLOYS FOR HIGH TEMPERATURE SERVICE IN LIQUID-SALT COOLED ENERGY SYSTEMS

(71) Applicant: UT-Battelle, LLC, Oak Ridge, TN (US)

(72) Inventors: David E. Holcomb, Oak Ridge, TN (US); Govindarajan Muralidharan, Knoxville, TN (US); Dane F. Wilson, Oak Ridge, TN (US)

(73) Assignee: UT-BATTELLE, LLC, Oak Ridge, TN (US)

( * ) Notice: Subject to any disclaimer, the term of this patent is extended or adjusted under 35 U.S.C. 154(b) by 441 days.

(21) Appl. No.: 13/834,985

(22) Filed: Mar. 15, 2013

(65) Prior Publication Data

US 2014/0271338 A1 Sep. 18, 2014

(51) Int. Cl.
*C22C 19/05* (2006.01)

(52) U.S. Cl.
CPC ..... *C22C 19/057* (2013.01)

(58) Field of Classification Search
CPC ..... C22C 19/057; C22F 1/10
USPC ..... 420/441; 148/675
See application file for complete search history.

(56) References Cited

U.S. PATENT DOCUMENTS

| | | | | |
|---|---|---|---|---|
| 2,684,299 | A | 7/1954 | Binder | |
| 3,030,206 | A | 4/1962 | Buck, Jr. | |
| 3,416,916 | A | 12/1968 | Herchenroeder | |
| 3,444,058 | A | 5/1969 | Mellors et al. | |
| 3,576,622 | A | 4/1971 | Mccoy | |
| 3,785,877 | A * | 1/1974 | Bailey | C22F 1/10 148/556 |
| 3,811,960 | A | 5/1974 | Perry et al. | |
| 3,917,463 | A | 11/1975 | Doi et al. | |
| 3,985,582 | A | 10/1976 | Bibring et al. | |
| 4,102,394 | A | 7/1978 | Botts | |
| 4,194,909 | A | 3/1980 | Ohmura et al. | |
| 4,476,091 | A | 10/1984 | Klarstrom | |
| 4,512,817 | A * | 4/1985 | Duhl et al. | 148/522 |
| 4,652,315 | A | 3/1987 | Igarashi et al. | |
| 4,740,354 | A | 4/1988 | Watanabe et al. | |
| 4,765,956 | A | 8/1988 | Smith et al. | |
| 4,818,486 | A | 4/1989 | Rothman et al. | |
| 4,820,359 | A | 4/1989 | Bevilacqua et al. | |
| 4,877,461 | A | 10/1989 | Smith et al. | |
| 5,077,006 | A | 12/1991 | Culling | |
| 5,167,732 | A | 12/1992 | Naik | |
| 5,244,515 | A | 9/1993 | Miglin | |
| 5,330,590 | A | 7/1994 | Raj | |
| 5,529,642 | A | 6/1996 | Sugahara et al. | |
| 5,567,383 | A | 10/1996 | Noda et al. | |
| 5,585,566 | A | 12/1996 | Welles, II et al. | |
| 5,660,938 | A | 8/1997 | Sato et al. | |
| 5,718,867 | A | 2/1998 | Nazmy et al. | |
| 5,779,972 | A | 7/1998 | Noda et al. | |
| 5,788,783 | A | 8/1998 | Coutu et al. | |
| 5,888,316 | A | 3/1999 | Erickson | |
| 5,916,382 | A | 6/1999 | Sato | |
| 5,951,789 | A | 9/1999 | Ueta et al. | |
| 6,099,668 | A | 8/2000 | Ueta et al. | |
| 6,224,824 | B1 * | 5/2001 | Zhang | C21D 8/005 148/335 |
| 6,344,097 | B1 | 2/2002 | Limoges et al. | |
| 6,372,181 | B1 | 4/2002 | Fahrmann et al. | |
| 6,610,154 | B2 | 8/2003 | Limoges et al. | |
| 6,702,905 | B1 | 3/2004 | Qiao | |
| 6,797,232 | B2 | 9/2004 | Speidel et al. | |
| 6,905,559 | B2 | 6/2005 | O'Hara et al. | |
| 6,908,518 | B2 | 6/2005 | Bouse et al. | |
| 7,011,721 | B2 | 3/2006 | Harris et al. | |
| 7,038,585 | B2 | 5/2006 | Hall et al. | |
| 7,042,365 | B1 | 5/2006 | Diaz-Lopez | |
| 7,089,902 | B2 | 8/2006 | Sato et al. | |
| 7,160,400 | B2 | 1/2007 | Magoshi et al. | |
| 7,450,023 | B2 | 11/2008 | Muralidharan et al. | |

(Continued)

FOREIGN PATENT DOCUMENTS

| | | |
|---|---|---|
| CA | 706339 | 3/1965 |
| CA | 1215255 | 12/1986 |

(Continued)

OTHER PUBLICATIONS

Bruemmer, Stephen M. and Gary S. Was, Microstructural and Microchemical Mechanisms Controlling Intergranular Stress Corrosion Cracking in Light-Water-Reactor Systems, Journal of Nuclear Materials, 1994, pp. 348-363, vol. 216.

Weitzel, P.S., Steam Generator for Advanced Ulta-Supercritical Power Plants 700 to 760C, Technical Paper, 2011, pp. 1-12.

Khan, T., The Development and Characterization of a High Performance Experimental Single Crystal Superalloy, pp. 145-155.

Freche, J.C., et al., Application of Powder Metallurgy to an Advanced-Temperature Nickel-Base Alloy, NASA-TN D-6560, pp. 1-22.

Barner, J.H. Von et al., "Vibrational Spectra of Fluoro and Oxofluoro Complexes of Nb(V) and Ta(V)", Materials Science Forum vols. 73-75 (1991) pp. 279-284 © (1991) Trans Tech Publications, Switzerland doi:10.4028/www.scientific.net/MSF.73-75.279.

(Continued)

*Primary Examiner* — Jessee Roe
*Assistant Examiner* — Jenny Wu
(74) *Attorney, Agent, or Firm* — Fox Rothschild LLP

(57) ABSTRACT

An essentially cobalt-free alloy consists essentially of, in terms of weight percent: 6.3 to 7.2 Cr, 0.5 to 2 Al, 0 to 5 Fe, 0.7 to 0.8 Mn, 9 to 12.5 Mo, 0 to 6 Ta, 0.75 to 3.5 Ti, 0.01 to 0.25 Nb, 0.2 to 0.6 W, 0.02 to 0.04 C, 0 to 0.001 B, 0.0001 to 0.002 N, balance Ni. The alloy is characterized by a γ' microstructural component in the range of 3 to 17.6 weight percent of the total composition. The alloy is further characterized by, at 850° C., a yield strength of at least 60 Ksi, a tensile strength of at least 70 Ksi, a creep rupture life at 12 Ksi of at least 700 hours, and a corrosion rate, expressed in weight loss [g/(cm$^2$sec)]$10^{-11}$ during a 1000 hour immersion in liquid FLiNaK at 850° C., in the range of 5.5 to 17.

9 Claims, 9 Drawing Sheets

(56) References Cited

U.S. PATENT DOCUMENTS

| | | | | |
|---|---|---|---|---|
| 7,507,306 | B2 | 3/2009 | Chen et al. | |
| 7,824,606 | B2 | 11/2010 | Heazle | |
| 7,825,819 | B2 | 11/2010 | Muralidharan et al. | |
| 8,147,749 | B2 | 4/2012 | Reynolds | |
| 8,313,591 | B2 | 11/2012 | Hirata et al. | |
| 2003/0190906 | A1 | 10/2003 | Winick | |
| 2004/0174260 | A1 | 9/2004 | Wagner | |
| 2005/0053513 | A1 | 3/2005 | Pike | |
| 2007/0152815 | A1 | 7/2007 | Meyers et al. | |
| 2007/0152824 | A1 | 7/2007 | Waterhouse et al. | |
| 2007/0152826 | A1 | 7/2007 | August et al. | |
| 2007/0284018 | A1* | 12/2007 | Hamano et al. | 148/428 |
| 2008/0001115 | A1 | 1/2008 | Qiao et al. | |
| 2008/0126383 | A1* | 5/2008 | Perrin | E21B 41/02 |
| 2009/0044884 | A1 | 2/2009 | Toschi et al. | |
| 2009/0081073 | A1 | 3/2009 | Barbosa et al. | |
| 2009/0081074 | A1 | 3/2009 | Barbosa et al. | |
| 2009/0087338 | A1 | 4/2009 | Mitchell et al. | |
| 2009/0194266 | A1 | 8/2009 | Conrad et al. | |
| 2010/0008790 | A1 | 1/2010 | Reynolds | |
| 2010/0116383 | A1 | 5/2010 | Cloue et al. | |
| 2010/0303666 | A1 | 12/2010 | Bain et al. | |
| 2010/0303669 | A1 | 12/2010 | Pankiw et al. | |
| 2011/0236247 | A1 | 9/2011 | Osaki et al. | |
| 2011/0272070 | A1 | 11/2011 | Jakobi et al. | |
| 2012/0279351 | A1 | 11/2012 | Gu et al. | |
| 2014/0271338 | A1 | 9/2014 | Holcomb et al. | |

FOREIGN PATENT DOCUMENTS

| | | | | |
|---|---|---|---|---|
| CA | 2688507 | A1 | 6/2011 | |
| CA | 2688647 | A1 | 6/2011 | |
| CN | 100410404 | C | 8/2008 | |
| CN | 202883034 | U | 4/2013 | |
| EP | 1647609 | | 4/2006 | |
| GB | 734210 | | 7/1955 | |
| GB | 943141 | A * | 11/1963 | C22F 1/10 |
| JP | S5684445 | A | 7/1981 | |
| JP | H07109539 | A | 4/1995 | |
| JP | 2012219339 | A | 11/2012 | |
| RU | 2479658 | C2 | 4/2013 | |
| WO | 9206223 | A1 | 4/1992 | |
| WO | 2008005243 | A2 | 1/2008 | |
| WO | 2009/145708 | A1 | 12/2009 | |
| WO | 2013080684 | A1 | 6/2013 | |

OTHER PUBLICATIONS

Devan, Jackson H. , "Effect of Alloying Additions on Corrosion Behaviour of Nickel-Molybdenum Alloys in Fused Fluoride Mixtures", ORNL-TM-2021, vol. I, J. H. DeVan; Oak Ridge National Laboratory Central Research Library Document Collection (May 1969).

Misra, Ajay K. et al., "Fluoride Salts and Container Materials for Thermal Energy Storage Applications in the Temperature Range 973 to 1400 K", 22nd Intersociety Energy Conversion Engineering Conference cosponsored by the AIAA, ANS, ASME, SAE, IEEE, ACS, and AIChE Philadelphia, Pennsylvania, Aug. 10-14, 1987. Department of Metallurgy and Materials Science, Case Western Reserve University , Cleve.

Polyakova, L.P. et al., "Electrochemical Study of Tantalum in Fluoride and Oxofluoride Melts", J. Electrochem. Soc., vol. 141, No. 11, Nov. 1994 The Electrochemical Society Inc., pp. 2982-2988.

Singh, Raj P. , "Processing of Ta2O5 Powders for Electronic Applications", Journal of Electronic Materials, vol. 30, No. 12, 2001, pp. 1584-1594.

Yoder, Graydon L. et al., "An experimental test facility to support development of the fluoride-salt-cooled high-temperature reactor", Annals of Nuclear Energy 64 (2014) 511-517.

Ignatiev et al.: "Alloys compatibility in molten salt fluorides: Kurchatov Institute related experience", Journal of Nuclear Materials, 441 (2013), 592-603.

Kondo et al.: "Corrosion characteristics of reduced activation ferritic steel, JLF-1 (8.92Cr—2W) in molten salts Flibe and Flinak, Fusion Engineering and Design", 84 (2009) 1081-1085.

Kondo et al.: "High Performance Corrosion Resistance of Nickel-Based Alloys in Molten Salt FLiBe", Fusion Science and Technology, 56, Jul. 2009, 190-194.

Delpech et al.: "MSFR: Material Issues and the Effect of Chemistry Control", GIF Symposium, Paris France, Sep. 9-10, 2009.

Liu et al.:"Investigation on corrosion behavior of Ni-based alloys in molten fluoride salt using synchrotron radiation techniques", Journal of Nuclear Materials, 440 (2013) 124-128.

Glazoff et al.: "Computational Thermodynamic Modeling of Hot Corrosion of Alloys Haynes 242 and HastelloyTM N for Molten Salt Service in Advanced High Temperature Reactors", Journal of Nuclear Energy Science & Power Generation Technology, 3(3), 2014.

Materials Compatibility for High Temperature Liquid Cooled Reactor Systems (RC-1) https://neup.inl.gov/SiteAssets/FY_2017_Documents/FY17_CINR_DRAFT_WORKSCOPES.pdf.

Zheng et al: "Corrosion of 316L Stainless Steel and Hastelloy N Superalloy in Molten Eutectic LiF—NaF—KF Salt and Interaction with Graphite", Nuclear Technology, 188(2), 2014, p. 192.

Zheng et al.: "Corrosion of 316 Stainless Steel in High Temperature Molten Li2BeF4 (FLiBe) Salt", Journal of Nuclear Materials, vol. 416, 2015, p. 143.

Olson et al.: Impact of Corrosion Test Container Material in Molten Fluorides, Journal of Solar Energy Engineering, v. 137(6), 061007, 2015.

Zheng et al: "High Temperature Corrosion of Hastelloy N in Molten Li2BeF4 (FLiBe) Salt", Corrosion, 71/10, 2015, p. 1257.

* cited by examiner

| Mo | Cr | Fe | Al | Ti | Nb | W |
|---|---|---|---|---|---|---|
| 10.05 | 6.64 | 0.43 | 2.61 | | 0.39 | |
| 9.66 | 5.90 | 5.56 | 1.59 | | | |
| 10.42 | | | 5.51 | 1.92 | | |
| 14.2 | 9.47 | | 3.06 | | 1.57 | |
| 13.77 | | | | 1.68 | 0.92 | |
| 10.2 | 4.79 | | 1.27 | | 2.91 | 1.72 |
| 10.2 | 4.30 | | 2.54 | 1.90 | | |
| 14.00 | 9.32 | | 3.06 | | 1.48 | |
| 10.76 | | | 1.30 | 2.71 | | |
| 11.35 | | | 2.16 | 2.02 | | |
| 12.69 | | | 5.61 | | 0.87 | |
| 10.36 | | | 1.40 | | 3.23 | 1.85 |

HIGH STRENGTH ALLOYS FOR HIGH TEMPERATURE SERVICE IN LIQUID-SALT COOLED ENERGY SYSTEMS

STATEMENT REGARDING FEDERALLY SPONSORED RESEARCH

The United States Government has rights in this invention pursuant to contract no. DE-ACO5-00OR22725 between the United States Department of Energy and UT-Battelle, LLC.

CROSS-REFERENCE TO RELATED APPLICATIONS

This patent application is related to U.S. patent application Ser. No. 13/833,357 entitled "Heat Exchanger Life Extension Via In-Situ Reconditioning" filed on Mar. 15, 2013, the entire disclosure of which is incorporated herein by reference.

BACKGROUND OF THE INVENTION

An ever-increasing demand for higher system thermal efficiency has necessitated the operation of power generation cycles and heat conversion systems for chemical processes at progressively higher temperatures. As system operating temperatures are increased, fewer materials with acceptable mechanical properties and environmental compatibility are known. This dearth of materials is particularly acute in applications at temperatures above 650° C. and at significant stress levels where liquid fluoride salts are favored as heat transfer media because of their high thermal capacity and low vapor pressure. There is therefore a need for structural alloys for high-temperature heat transfer applications in order to enable increased thermal efficiency of energy conversion and transport systems thereby reducing system costs as well as reducing the waste heat rejected to the environment.

Fluoride salt cooled High temperature Reactors (FHRs) potentially have attractive performance and safety attributes. Defining features of FHRs include coated particle fuel, low-pressure fluoride salt cooling, and high-temperature heat production. The FHR heat transfer technology base is derived primarily from earlier molten salt reactors and their coated particle fuel is similar to that developed for high-temperature helium-cooled reactors. The excellent heat transfer characteristics of liquid fluoride salts enable full passive safety, at almost any power scale thereby enabling large power output reactors, with less massive piping and containment structures, and consequent economies of scale. FHRs potentially have improved economics, increased safety margins, and lower water usage characteristics than conventional water-cooled reactors.

The fuel and coolants for FHRs are suitable for operation at temperatures well in excess of the upper temperature limits of available structural alloys. A limiting factor in achieving the highest possible FHR core outlet temperatures and thus thermal efficiency is the availability of structural alloys having sufficient creep strength at the required temperatures combined with suitable fluoride salt chemical compatibility as well as ease of fabrication. Hastelloy® N (trademark owned by Haynes International, Inc.) (also known as Alloy N and INOR-8), developed at Oak Ridge National laboratory (ORNL) in the 1950s and 1960s, is currently a leading candidate FHR structural alloy for operations below 700° C. Alloy N is limited to use in low stress applications to a maximum temperature of about 704° C. due to insufficient creep strength at higher temperatures, is limited to use in high stress applications such as steam generator tubes to about 600° C. due to insufficient creep strength at higher temperatures, is not fully qualified to current code requirements for high temperature reactors, and is challenging to fabricate due to its work hardening characteristics. There is therefore a need for corrosion-resistant nickel-based structural alloys designed to possess good creep resistance in liquid fluorides at higher temperatures in order to provide substantial improvements in FHR economics and performance. Calculations reveal that a net thermal efficiency of greater than 50% (as compared to about 33% net thermal efficiency of existing reactors) would be likely for FHRs using a high temperature structural alloy with concurrent reductions in capital costs, waste generation, fissile material requirements, and cooling water usage.

In general, conventional Ni-based alloys are strengthened through a combination of solid solution strengthening and precipitation strengthening mechanisms with the latter needed to achieve higher strengths at higher temperatures. In one class of Ni-based superalloys, primary strengthening is obtained through the homogeneous precipitation of ordered, $L1_2$ structured, $Ni_3(Al,Ti,Nb)$-based intermetallic precipitates that are coherently embedded in a solid solution FCC matrix. In another class of Ni-based alloys, creep resistance is achieved through the precipitation of fine carbides ($M_{23}C_6$, $M_7C_3$, $M_6C$ where M is primarily Cr with substitution of Mo, W, for example) and carbonitrides (M(C, N) where M is primarily Nb, or Ti, for example) within the matrix, and larger carbides on grain boundaries to prevent grain boundary sliding. Moreover, high temperature oxidation resistance in these alloys is obtained through additions of Cr and Al. Existing data (shown in FIG. 1) on liquid fluoride salt resistance of Ni-based alloys show that alloys containing aluminum, and substantial amounts of chromium have lower resistance to liquid fluoride salt. Commercial Nickel-based alloys with high strengths typically contain significant amounts of Cr (greater than 15 wt. % Cr) making them unsuitable for use in contact with liquid fluoride salts. Compositions (in weight %) of several commercially produced Ni-based alloys strengthened by γ' precipitation are shown in Table 1.

Hastelloy® N is an alloy that was designed to balance resistance to liquid fluoride salt corrosion with good creep properties at temperatures up to 704° C. This alloy is a Ni—Mo alloy containing additional alloying elements with solid solution strengthening being the primary strengthening mechanism; Hastelloy® N does not have γ' precipitation strengthening. Its nominal composition is given as $$71Ni-7Cr-16Mo-5Fe^*-1Si^*-0.8Mn^*-0.2Co^*-0.35Cu^*-0.5W^*-0.35Al+Ti^*-0.08C^*$$

where * indicates maximum allowed content of the indicated elements. Hastelloy® N generally consists of the following elements to provide the corresponding benefits:

Chromium: Added to ensure good oxidation resistance but minimized to keep liquid fluoride salt corrosion within acceptable limits. Also provides solid solution strengthening. Too much addition results in excessive attack by liquid fluoride salts.

Molybdenum: Principal strengthening addition for solid solution strengthening, provides good resistance to liquid fluoride salt, and results in lower interdiffusion coefficients. Also is the primary constituent in $M_6C$ carbides. Too much addition can result in the formation of undesirable, brittle intermetallic phases.

Iron: Provides solid solution strengthening. Too much addition can destabilize austenitic matrix and decrease resistance to liquid fluoride salt.

Manganese: Stabilizes the austenitic matrix phase. Provides solid solution strengthening.

Silicon: Assists in high temperature oxidation resistance, a maximum of 1% Si may be added.

Carbon, Nitrogen: Required for the formation of carbide and/or carbonitride phases that can act as grain boundary pinning agents to minimize grain growth and to provide resistance to grain boundary sliding. Fine precipitation of carbide and/or carbonitride phases can increase high temperature strength and creep resistance.

Copper: Stabilizes the austenitic matrix, provides solid solution strengthening.

Cobalt: Provides solid solution strengthening.

Tungsten: Provides solid solution strengthening and decreases average interdiffusion coefficient. Too much can result in the formation of brittle intermetallic phases that can be deleterious to processability.

Aluminum+Titanium are not desirable in Hastelloy® N, in order to minimize corrosion by liquid salt. Combined wt. % of Al+Ti is typically kept to less than 0.35.

FIG. 1 shows effects of alloying element additions on the depth of corrosion of Ni-alloys in 54.3LiF-41.0KF-11.2NaF-2.5$UF_4$ (mole percent) in a thermal convention loop operated between 815 and 650° C. (smaller depth of corrosion is better).

FIG. 2 shows the equilibrium phase fractions in Hastelloy® N as a function of temperature. Note that solid solution strengthening and some carbide strengthening (through $M_6C$) are the primary strengthening mechanisms active in Hastelloy® N. This limits the strength and creep resistance of Hastelloy® N at high temperatures and restricts its useful temperatures to less than about 704° C. Components such as secondary heat exchangers need to withstand large pressure differences between salt on one side of the heat exchanger wall and a gaseous fluid at higher pressures on the other side. Such components hence need materials with high temperature strength greater than that of Hastelloy® N along with good resistance to salt, good oxidation resistance, and in the case of FHRs, tolerance to nuclear irradiation.

BRIEF SUMMARY OF THE INVENTION

It is an object of the invention to provide high temperature alloys that are applicable to FHRs) molten salt reactors, high temperature solar power systems, and high temperature heat-transfer systems for which increased efficiency is directly associated with economic performance.

In accordance with one aspect of the present invention, the foregoing and other objects are achieved by an essentially cobalt-free alloy consisting essentially of, in terms of weight percent: 6.3 to 7.2 Cr, 0.5 to 2 Al, 0 to 5 Fe, 0.7 to 0.8 Mn, 9 to 12.5 Mo, 0 to 6 Ta, 0.75 to 3.5 Ti, 0.01 to 0.25 Nb, 0.2 to 0.6 W, 0.02 to 0.04 C, 0 to 0.001 B, 0.0001 to 0.002 N, balance Ni. The alloy is characterized by a γ' microstructural component in the range of 3 to 17.6 weight percent of the total composition. The alloy is further characterized by, at 850° C., a yield strength of at least 60 Ksi, a tensile strength of at least 70 Ksi, a creep rupture life at 12 Ksi of at least 700 hours and a corrosion rate, expressed in weight loss $[g/(cm^2sec)]10^{-11}$ during a 1000 hour immersion in liquid FLiNaK at 850° C., in the range of 5.5 to 17.

Figure 1:
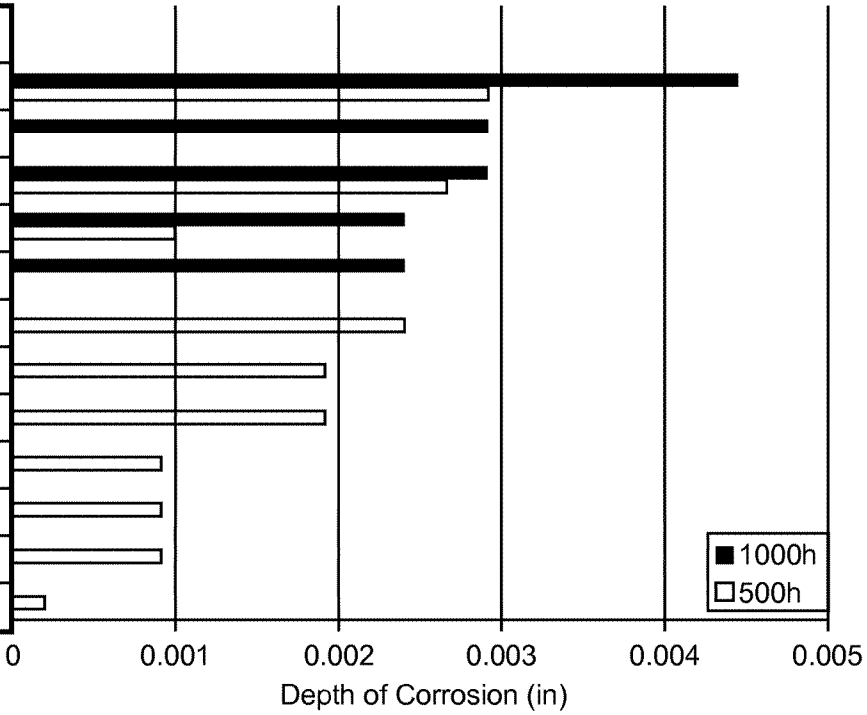
FIG. 1 is a combination table and bar graph showing effects of alloying element additions on the depth of corrosion of Ni-alloys in 54.3LiF-41.0KF-11.2NaF-2.5$UF_4$ (mole percent) in a thermal convention loop operated between 815 and 650° C. A2,AMD

For a better understanding of the present invention, together with other and further objects, advantages and capabilities thereof, reference is made to the following disclosure and appended claims in connection with the above-described drawings.

DETAILED DESCRIPTION OF THE INVENTION

Development of a high temperature structural alloy tailored to the specific high temperature strength and liquid salt corrosion resistance needs of liquid fluoride salt cooled-energy systems (especially FHRs) is contemplated to be of critical importance to ensuring feasibility and performance thereof. Simultaneously achieving creep resistance and liquid fluoride salt resistance at higher temperatures is challenging because conventional additions of certain alloying elements for achieving improved creep resistance and resistance to oxidation in air are detrimental to liquid fluoride salt resistance. For example, chromium which is added to nickel-based alloys for oxidation resistance is detrimental for resistance to liquid fluoride salt attack.

Moreover, cobalt should not be present (other than insignificant amount as an impurity) in alloys exposed to high neutron fluxes or whose corrosion products are exposed to high neutron fluxes, since cobalt is susceptible to activation. The alloy of the present invention is therefore essentially cobalt-free.

Alloys described herein have been developed to have acceptable resistance to liquid salt along with improved strength and creep resistance at temperatures above 704° C. The primary strengthening in the new alloys is achieved through the precipitation of coherent γ' precipitates along with solid solution strengthening. A small amount of carbides is also present to prevent grain boundary sliding. Computational design of alloys was also used to ensure that no brittle intermetallic phases form in these alloys in the temperature range of interest. In these alloys, small amounts of Al, Ti, Nb have been added to form γ' precipitates. Ta and W have been added for additional solid solution strengthening. Ta also partitions to the γ' phase changing its stability with temperature. Addition of elements such as Ta and W also reduces the average interdiffusion coefficient in the alloy.

The primary advantage of solid solution strengthened alloys is microstructural stability. Strengthening is primarily obtained through the presence of solute elements in solid solution that may be different in size, and/or chemical composition from the solvent, and not through the presence of precipitates. Therefore, microstructural changes such as coarsening of precipitates will not be relevant in determining the properties of such alloys. Furthermore, fabrication such as forming and welding operations are simpler due to solid-solution strengthening being the primary strengthening mechanism. However, solid solution strengthened alloys can be used only in applications that need relatively lower yield and tensile strengths and lower creep strength when compared to precipitation-strengthened alloys but require consistent properties for a very long period of time (25-80 years). The γ'-strengthened alloys of the present invention provide the higher strength required for applications for which the solid solution strengthened alloys have insufficient strength.

One disadvantage with γ' alloys is that the strength decreases with time at temperature due to the coarsening of γ' precipitates with time. The rate of loss of strength is directly related to the rate of coarsening of precipitates which increases with increase in temperature (which also results in an increase in interdiffusion coefficients). Thus other techniques have to be used to prolong the lifetime of these alloys in the applications where the alloys are subject to coarsening.

Constituent ranges for alloys of the present invention are set forth in Table 2. Some examples thereof are set forth in Table 3, with Hastelloy® N for comparison. It is contemplated that alloys of the present invention may contain up to 5% Fe with concomitant reduction in some beneficial properties, such as creep resistance and oxidation resistance.

Aluminum and titanium provide strengthening through the formation of γ' precipitates. Too much addition can be detrimental to resistance to liquid fluoride salt corrosion due to dissolution of Al and Ti in the liquid salt. Moreover, too much Al and/or Ti can result in the formation of brittle intermetallic phases that can be deleterious to processability. Al content of 0.75 wt % is contemplated to be a practical minimum for the formation of sufficient γ' precipitates for most applications, such as FHRs, for example. It is further contemplated that Al content as low as 0.5 wt. % is suitable for some applications, with concomitant reduction of γ' precipitates and associated benefits.

Alloys of the present invention can have carbide microstructural components (also known as carbide phases), expressed herein as $M_6C$, in the amount of 1-2 wt. %, preferably 1.1-1.5%.

Figure 2:
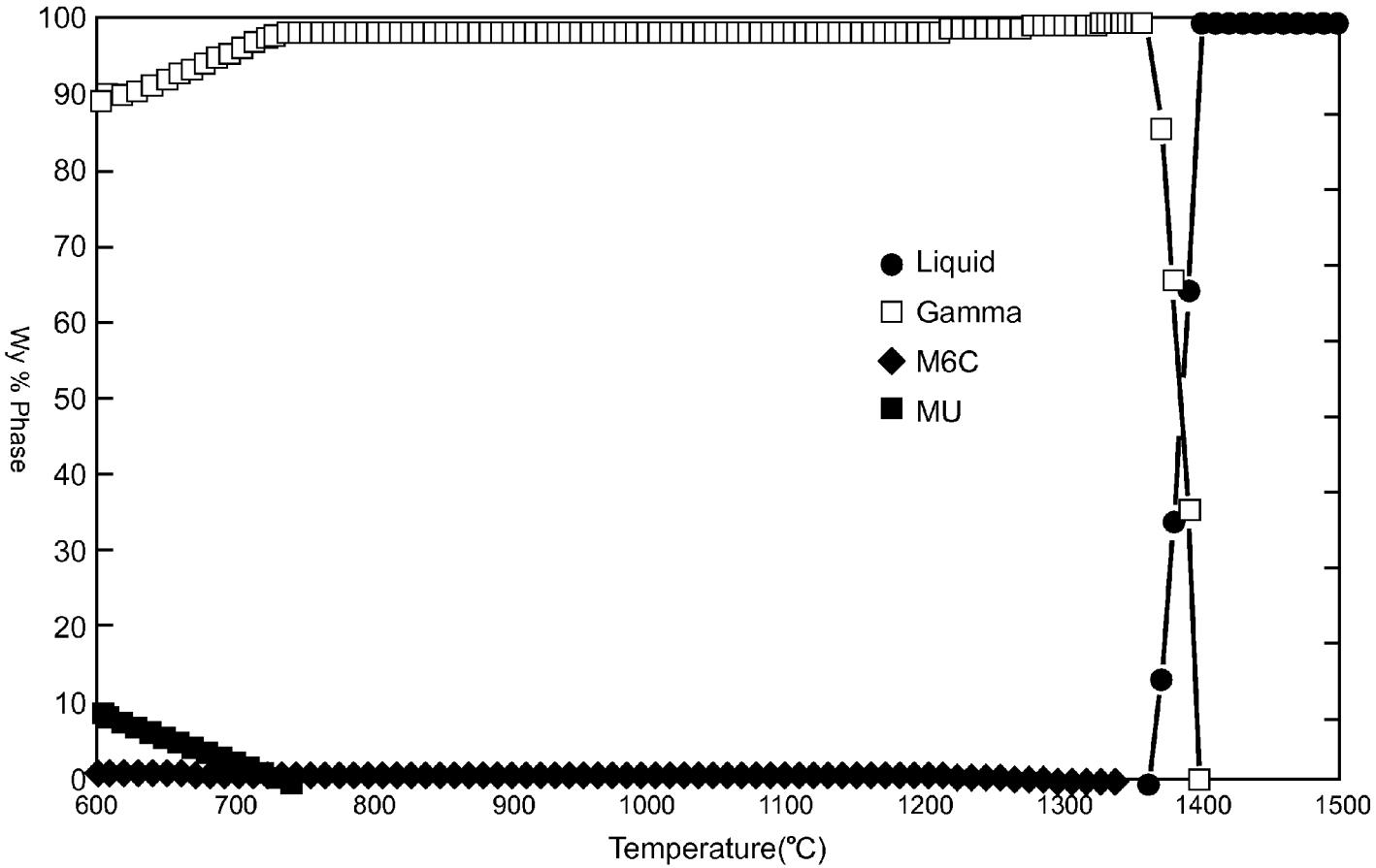
FIG. 2 is a graph showing phase equilibria for a typical composition of Hastelloy® N as a function of temperature (nitrogen and boron are not included in the calculations).
Figure 3:
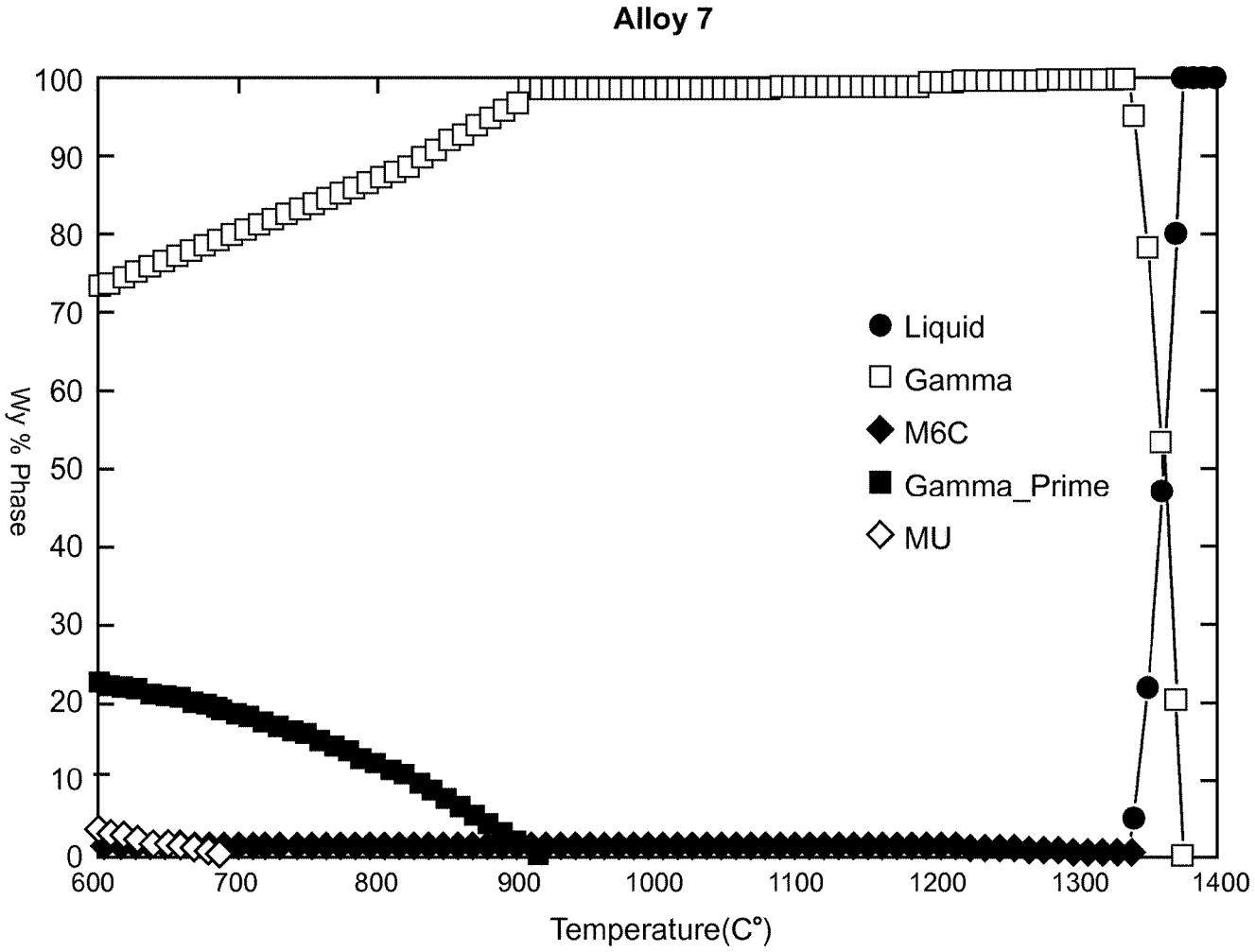
FIG. 3 is a graph showing phase equilibria for Alloy 7 as a function of temperature (nitrogen and boron are not included in the calculations).
Figure 4:
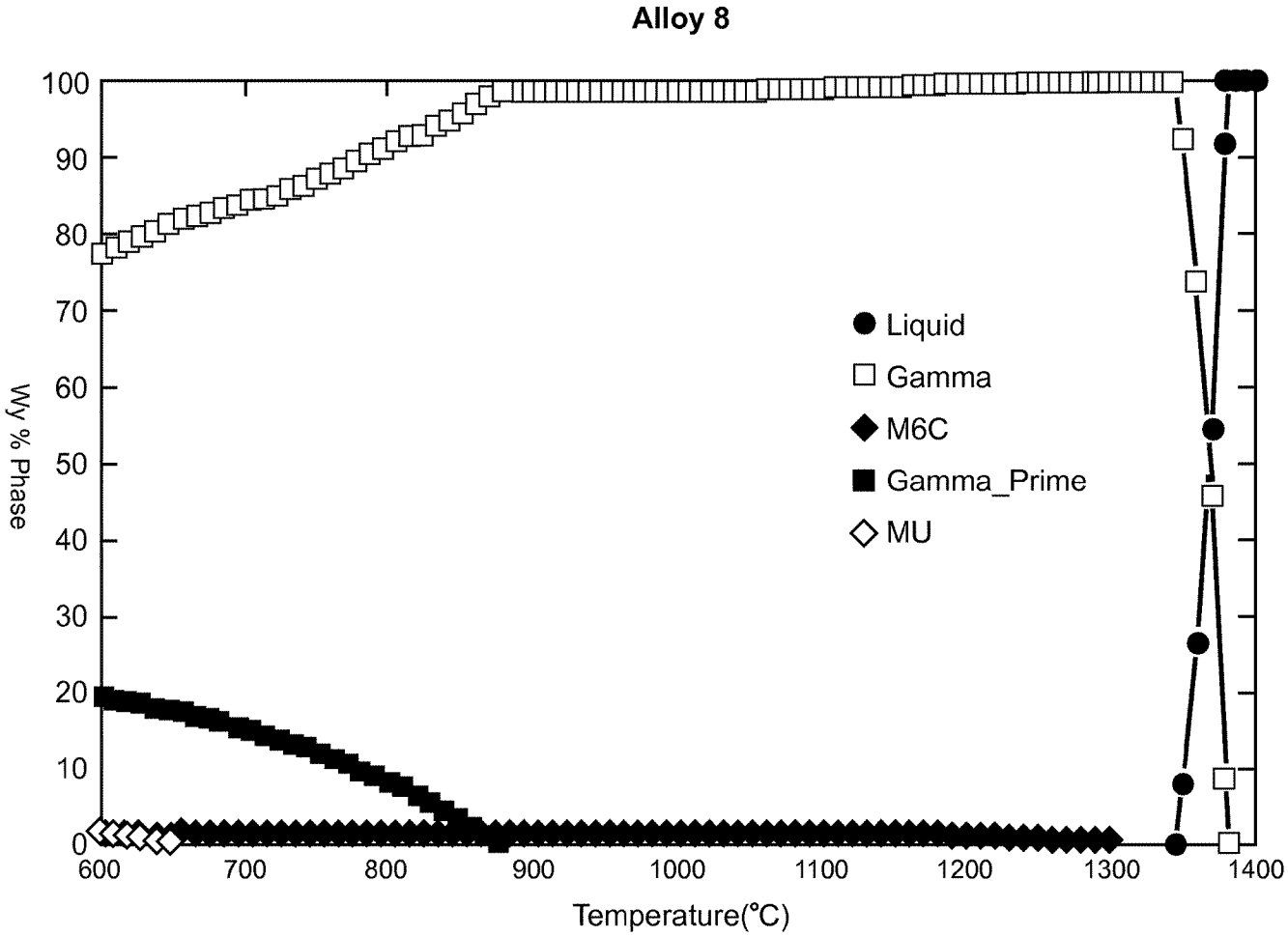
FIG. 4 is a graph showing phase equilibria for Alloy 8 as a function of temperature (nitrogen and boron are not included in the calculations).
Figure 5:
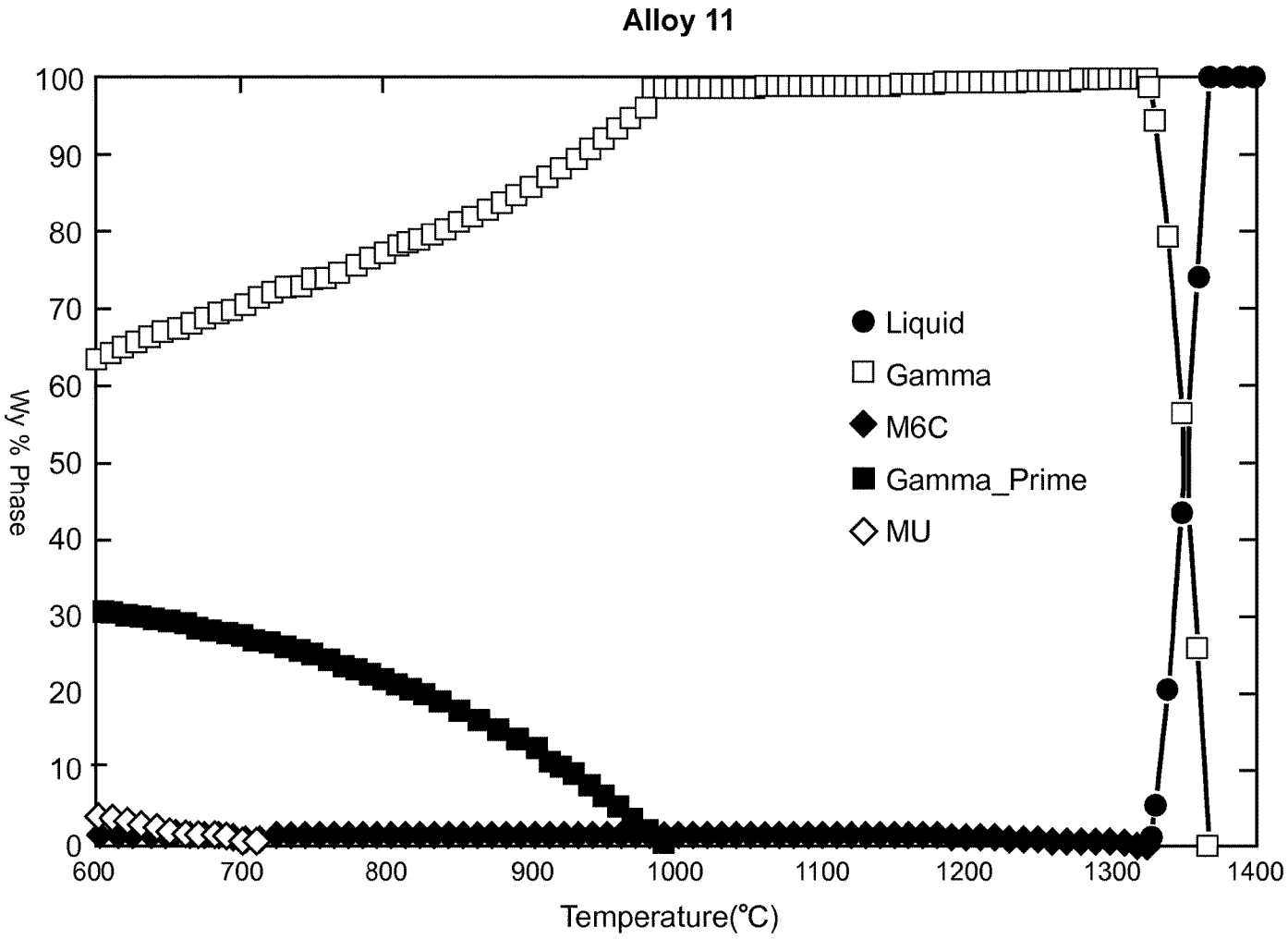
FIG. 5 is a graph showing phase equilibria for Alloy 11 as a function of temperature (nitrogen and boron are not included in the calculations).
Figure 6:
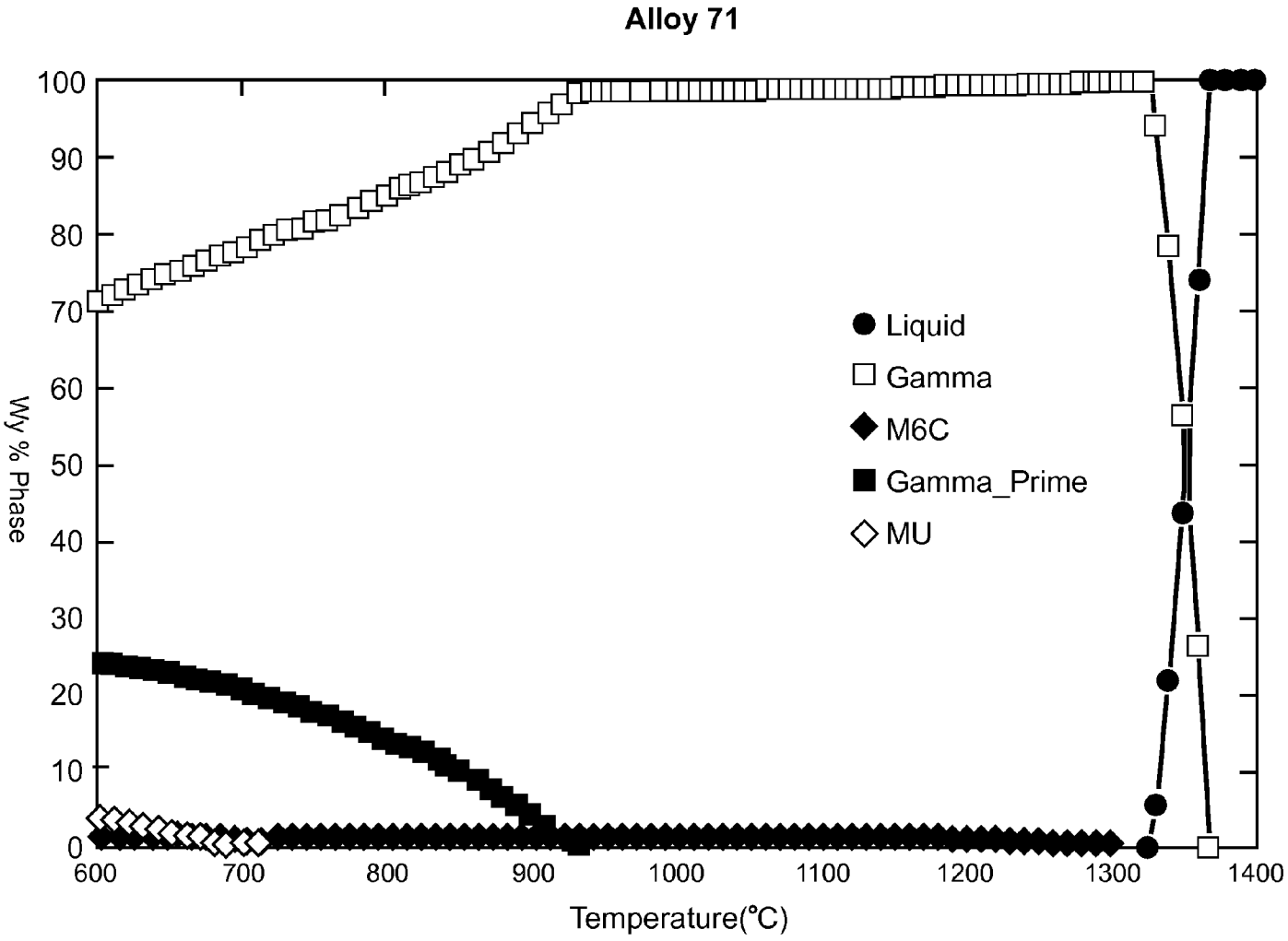
FIG. 6 is a graph showing phase equilibria for Alloy 71 as a function of temperature (nitrogen and boron are not included in the calculations).
Figure 7:
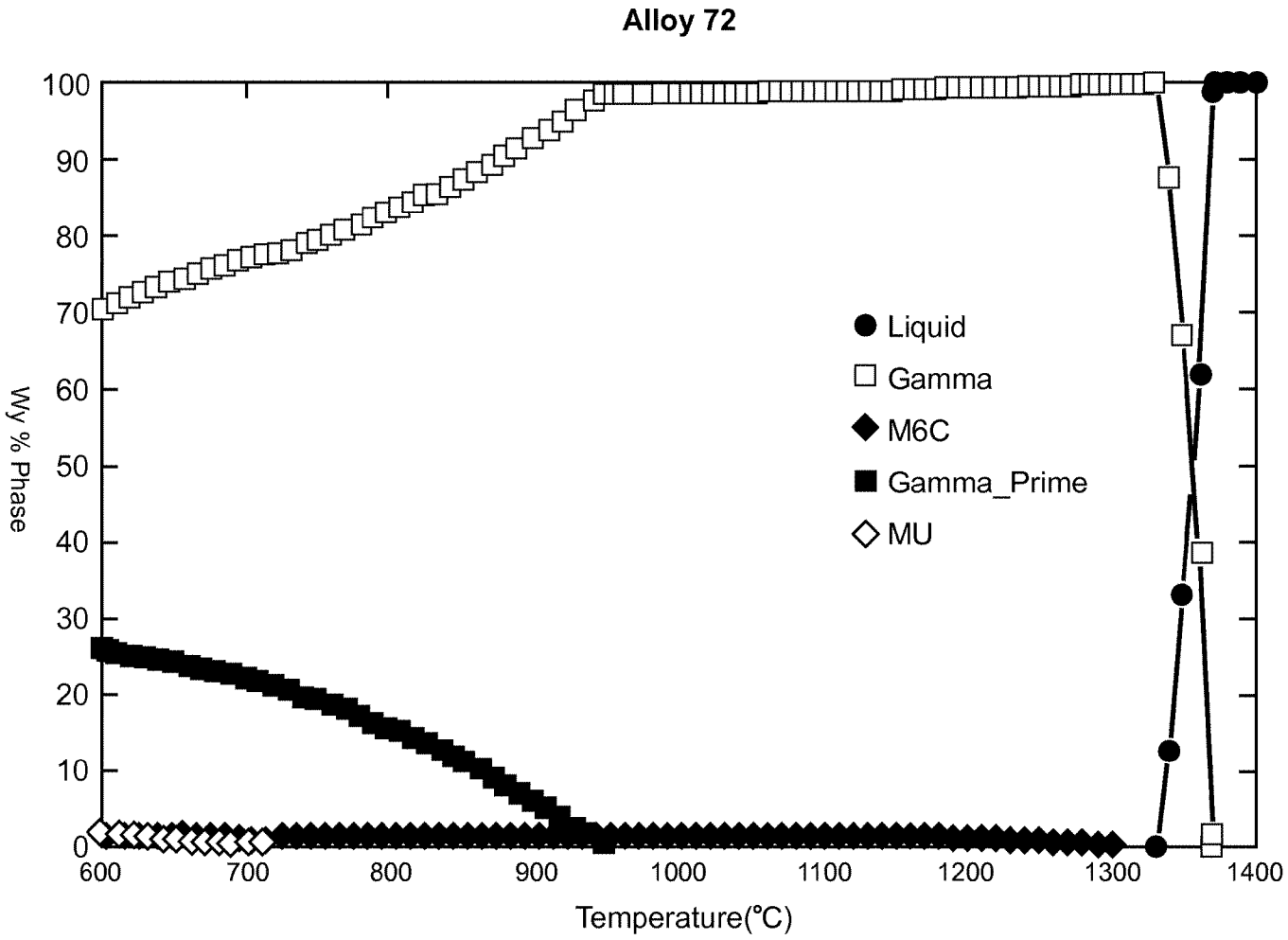
FIG. 7 is a graph showing phase equilibria for Alloy 72 as a function of temperature (nitrogen and boron are not included in the calculations).
Figure 8:
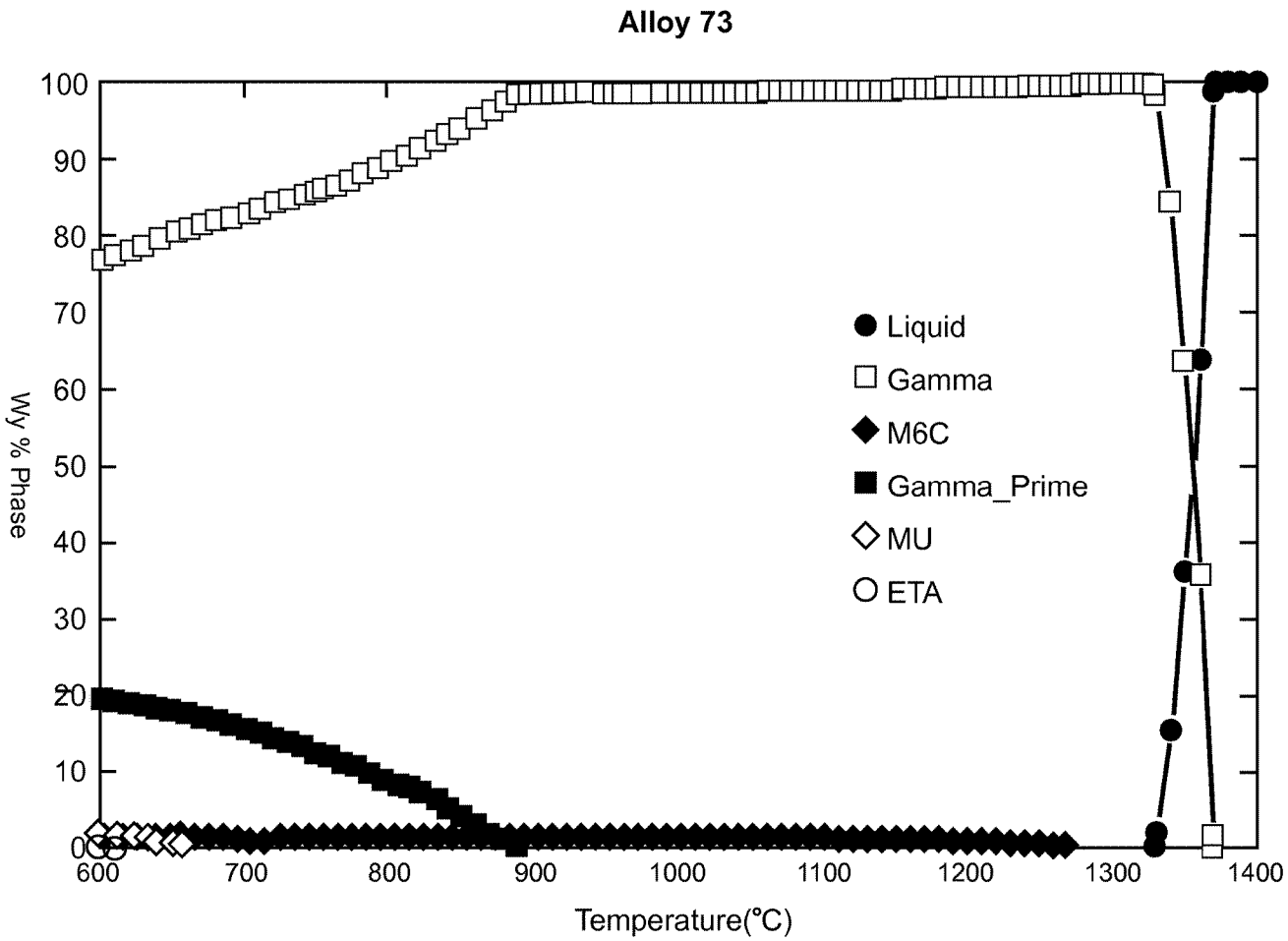
FIG. 8 is a graph showing phase equilibria for Alloy 73 as a function of temperature (nitrogen and boron are not included in the calculations).
Figure 9:
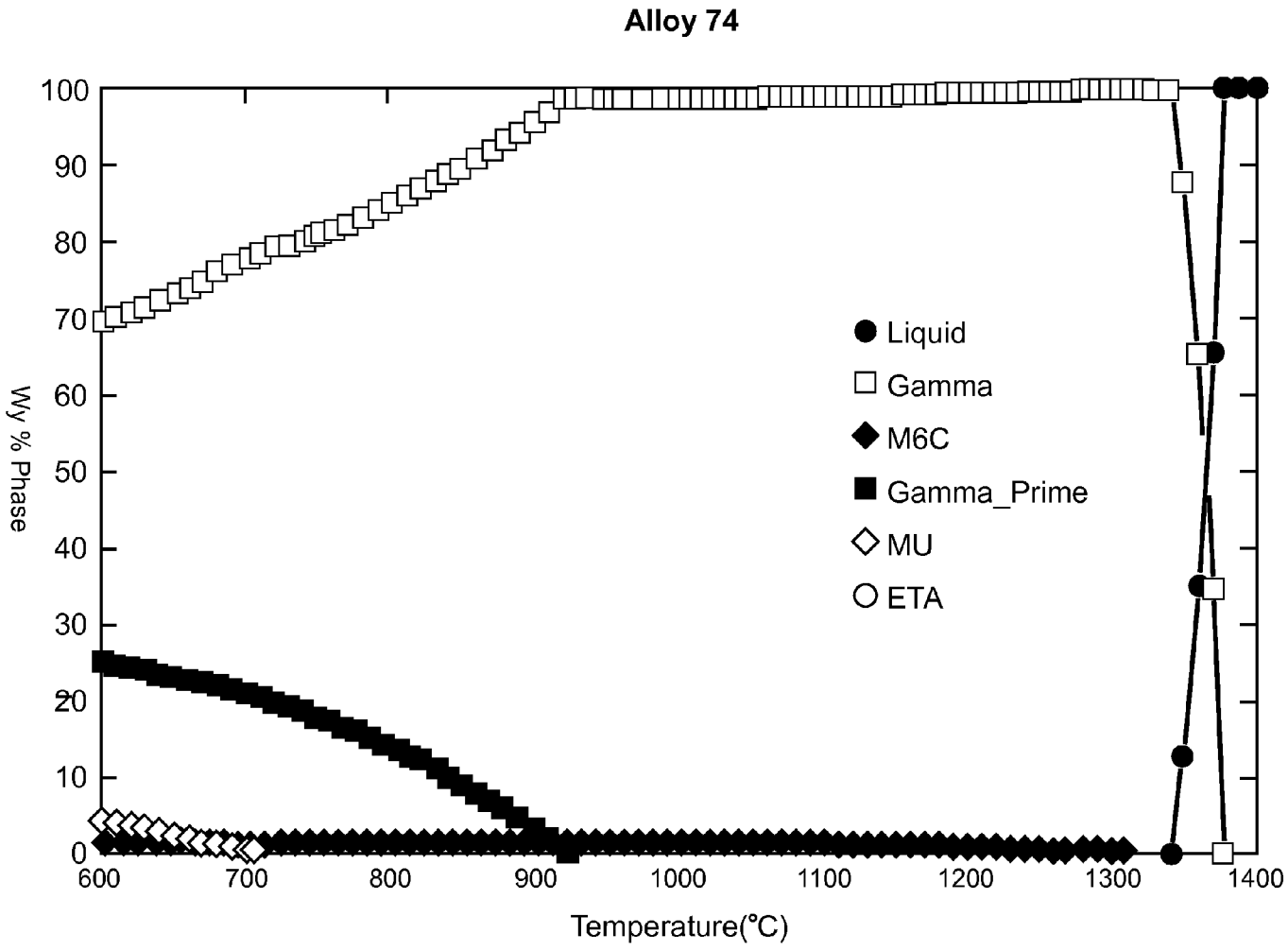
FIG. 9 is a graph showing phase equilibria for Alloy 74 as a function of temperature (nitrogen and boron are not included in the calculations).

FIGS. 2-9 show results from equilibrium calculations obtained from the computational thermodynamics software JMatPro v 6.2 (trade name for software owned by Sente Software Ltd., Surrey Technology Centre 40 Occam Road GU2 7YG United Kingdom). Actual compositions were used for all the calculations.

Alloy compositions of the present invention can be made using well known, conventional methods. For example, constituents can be blended by vacuum arc casting or another conventional melting and casting method. Also for example, cast ingots can be annealed at 1000-1400° C. in an inert environment such as vacuum, inert gas or gas mixture. Further for example, the annealed ingots can be formed by hot rolling, forging, or other conventional, mechanical processing method. Further for example, following forming, the alloys can be solution annealed at 1000-1200° C. for 2-10 hours. Subsequently, for example, the alloys can be further processed by an aging treatment at 700-800° C. for 8-30 hours. The skilled artisan will recognize that various processes, temperature, and time combinations can be used to achieve the same or similar results.

EXAMPLES

Alloys 7, 8, 11, 71, 72, 73, and 74, shown in Table 3, were made as described herein. Vacuum arc cast ingots were annealed at 1200° C. in an inert gas environment. The ingots were then hot-rolled into plates for mechanical testing. A solution annealing treatment was performed at 1121° C. for 4 hours followed by an aging treatment at 760° C. for 16 hours.

Alloy 11 cracked when standard rolling techniques were applied, indicating the formation of excessive γ' precipitate for the process parameters used. Alloy 72 formed less excessive γ' precipitate and exhibited a lesser tendency to crack during rolling; some routine experimentation was necessary to roll it without significant cracking. Some data was therefore not determined for the foregoing samples. All the other alloys within the scope of the invention were successfully cast, heat-treated, and mechanically processed into plates and sheets for various applications using conventional methods. It is contemplated, however, that Alloy 11 and Alloy 72 can be successfully formed by optimizing the processing parameters through routine experimentation.

Weight % of phases present in the example alloys in equilibrium at 850° C. are shown in Table 4. The γ' microstructural component is contemplated to be typically present in an amount of a calculated weight percent of at least 3 and no more than 17.6, for some applications no more than 11.8, for other applications no more than 9.4.

Yield and tensile strengths have been measured in the aged condition at 850° C. and compared with the baseline properties of Alloy N and are shown in Table 5. Note that the tensile strengths of the new alloys at 850° C. are much better than that of Alloy N with an improvement of 66-87% in tensile strengths at 850° C. compared to Alloy N. Typical yield strengths of alloys of the present invention are contemplated to be in the range of 60-90 Ksi, preferably at least 65 Ksi. Typical tensile strengths of alloys of the present invention are contemplated to be in the range of 70-90 Ksi, preferably at least 75 Ksi.

Creep rupture life has been measured in the aged condition at 850° C. at a stress level of 12 Ksi in an inert atmosphere with the new alloys showing improvements in rupture lives of greater than 10,000% as shown in Table 6. Creep rupture lives of alloys of the present invention are contemplated to be in the range of 700-900 hours, preferably at least 750 hours.

Resistances to liquid salt corrosion were measured by placing the alloy specimens of measured dimensions and weight in sealed (under inert argon atmosphere) molybdenum capsules in contact with a fixed amount of FLiNaK, a liquid salt heat exchange medium. The molybdenum capsules were enclosed in an outer capsule of a high-temperature-oxidation resistant material to minimize high temperature air oxidation of the molybdenum and heated in at 850° C. for 1,000 hours. After exposure, the capsules were opened and the specimens cleaned, weighed and their dimension measured. Corrosion resistance to liquid fluoride salt was evaluated based on normalized weight change and metallography and scanning electron microscopy. Results obtained, presented in Table 7 (lower value is better), demonstrate that these alloys all have corrosion rates slightly higher than that of Hastelloy® N in the isothermal tests but with significantly improved mechanical properties. Typical corrosion rates of alloys of the present invention, expressed in weight loss $[g/(cm^2 sec)]\times10^{-11}$ during a 1000 hour immersion in liquid FLiNaK at 850° C., are contemplated to be in the range of about 5.5 to about 17, preferably no more than about 8.4 Thus a balance has been struck between improved mechanical properties and resistance to attack by liquid fluoride salt.

Table 8 shows the corrosion susceptibility index which quantifies the susceptibility to corrosion of the alloys shown in Table 3 by liquid fluoride salts, specifically FLiNaK. For this purpose, we define the corrosion susceptibility index (CSI) as $$CSI = \frac{\%\ Al + \%\ Cr + \%\ Ti + \%\ Nb + \%\ Hf + \%\ Ta}{\%\ Ni + \%\ Fe + \%\ Co + \%\ Mn + \%\ Mo + \%\ W + \%\ Re + \%\ Ru}$$

where % refers to atomic percent of the element present in the alloy. It has been observed that for the alloys described herein, CSI should be within a range of about 0.14 to about 0.2, in addition to maintaining the elements in the preferred wt. % ranges. This results in the optimum combination of mechanical properties (high temperature strength and creep resistance) and resistance to fluoride salts.

Tables 1-8 follow.

While there has been shown and described what are at present considered to be examples of the invention, it will be obvious to those skilled in the art that various changes and modifications can be prepared therein without departing from the scope of the inventions defined by the appended claims.

TABLE 1

Compositions of several commercial Ni-based alloys strengthened by γ' precipitation (in weight %).

| Alloy | C | Si | Mn | Al | Co | Cr | Cu | Fe | Mo | Nb | Ni | Ta | Ti | W | Zr |
|---|---|---|---|---|---|---|---|---|---|---|---|---|---|---|---|
| X750 | 0.03 | 0.09 | 0.08 | 0.68 | 0.04 | 15.7 | 0.08 | 8.03 | — | 0.86 | Bal | 0.01 | 2.56 | — | — |
| Nimonic 80A | 0.08 | 0.1 | 0.06 | 1.44 | 0.05 | 19.6 | 0.03 | 0.53 | — | — | Bal | — | 2.53 | — | — |
| IN 751 | 0.03 | 0.09 | 0.08 | 1.2 | 0.04 | 15.7 | 0.08 | 8.03 | — | 0.86 | Bal | 0.01 | 2.56 | — | — |
| Nimonic 90 | 0.07 | 0.18 | 0.07 | 1.4 | 16.1 | 19.4 | 0.04 | 0.51 | 0.09 | 0.02 | Bal | — | 2.4 | — | 0.07 |
| Waspaloy | 0.03 | 0.03 | 0.03 | 1.28 | 12.5 | 19.3 | 0.02 | 1.56 | 4.2 | — | Bal | — | 2.97 | — | 0.05 |
| Rene 41 | 0.06 | 0.01 | 0.01 | 1.6 | 10.6 | 18.4 | 0.01 | 0.2 | 9.9 | — | Bal | — | 3.2 | — | — |
| Udimet 520 | 0.04 | 0.05 | 0.01 | 2.0 | 11.7 | 18.6 | 0.01 | 0.59 | 6.35 | — | Bal | — | 3.0 | — | — |
| Udimet 720 | 0.01 | 0.01 | 0.01 | 2.5 | 14.8 | 15.9 | 0.01 | 0.12 | 3.0 | 0.01 | Bal | — | 5.14 | 1.23 | 0.03 |
| Alloy 617 | 0.07 | 0 | 0 | 1.2 | 12.5 | 22 | 0 | 1 | 9 | 0 | 54 | 0 | 0.3 | 0 | 0 |

TABLE 2

Compositions of new γ' strengthened alloys (analyzed compositions in wt. %)

| Element | Minimum wt. % | Maximum wt. % |
|---|---|---|
| Cr | 6.3 | 7.2 |
| Al | 0.5* | 2 |
| Fe | 0 | 0.05** |
| Mn | 0.7 | 0.8 |
| Mo | 9 | 12.5 |
| Ta | 0 | 6 |
| Ti | 0.75 | 3.5 |
| Nb | 0.01 | 0.25 |
| W | 0.2 | 0.6 |
| C | 0.02 | 0.04 |
| B | 0 | 0.001 |
| N | 0.0001 | 0.002 |
| Ni | Balance | |
| Co | Essentially 0 | |

*0.75% Al is a recommended minimum content. It is contemplated that alloys of the present invention may contain as low as 0.5% Al with concomitant reduction in γ' strengthening and associated beneficial properties.

**0.05% Fe is a recommended maximum content. It is contemplated that alloys of the present invention may contain up to 5% Fe with concomitant reduction in some beneficial properties, such as creep resistance and oxidation resistance.

TABLE 3

Compositions of new γ' strengthened alloys (analyzed compositions in wt. %)

| Alloy | Ni | Fe | Al | Co | Cr | Mn | Mo | Ti |
|---|---|---|---|---|---|---|---|---|
| Hastelloy ® N* | 68.7 | 5 | ** | 0.2 | 7 | 0.8 | 16 | ** |
| Alloy 7 | 76.211 | 0.01 | 1.3 | 0 | 6.57 | 0.76 | 11.76 | 2.84 |
| Alloy 8 | 76.649 | 0.01 | 1.23 | 0 | 6.56 | 0.74 | 11.78 | 2.43 |
| Alloy 11 | 76.0369 | 0.01 | 1.73 | 0 | 6.53 | 0.76 | 10.92 | 3.41 |
| Alloy 71 | 75.2616 | 0.01 | 1.26 | 0 | 6.98 | 0.75 | 10.06 | 2.97 |
| Alloy 72 | 75.6536 | 0 | 1.48 | 0 | 6.88 | 0.73 | 9.86 | 2.94 |
| Alloy 73 | 75.8728 | 0.01 | 0.98 | 0 | 6.85 | 0.77 | 9.62 | 2.94 |
| Alloy 74 | 72.5641 | 0 | 1.84 | 0 | 7.05 | 0.75 | 10.25 | 0.99 |

| Alloy | Nb | Ta | W | C | B | N | Total |
|---|---|---|---|---|---|---|---|
| Hastelloy ® N* | 0 | 0 | 0.5 | 0.08 | 0.01 | — | 100 |
| Alloy 7 | 0.01 | 0 | 0.51 | 0.029 | 0.0005 | 0.0005 | 100 |
| Alloy 8 | 0.01 | 0 | 0.56 | 0.031 | 0 | 0.0003 | 100 |
| Alloy 11 | 0.01 | 0 | 0.56 | 0.032 | 0.0004 | 0.0007 | 100 |
| Alloy 71 | 0.23 | 1.95 | 0.49 | 0.037 | 0.0003 | 0.0011 | 100 |
| Alloy 72 | 0 | 1.94 | 0.48 | 0.036 | 0.0003 | 0.0001 | 100 |
| Alloy 73 | 0.22 | 2.2 | 0.5 | 0.036 | 0.0003 | 0.0009 | 100 |
| Alloy 74 | 0.22 | 5.82 | 0.48 | 0.035 | 0.0005 | 0.0004 | 100 |

*Hastelloy ® N also contains 1 Si, 0.35 Cu; N content is unknown.
**Al + Ti < 0.35%

TABLE 4

Weight % of Phases Present in the Alloys in Equilibrium at 850° C.

| Alloy | Wt. % γ | Wt. % $M_6C$ | Wt. % γ' |
|---|---|---|---|
| Hastelloy ® N | 98.77 | 1.23 | 0 |
| Alloy 7 | 91.45 | 1.17 | 7.38 |
| Alloy 8 | 95.74 | 1.24 | 3.02 |
| Alloy 11 | 81.17 | 1.28 | 17.55 |
| Alloy 71 | 89.16 | 1.47 | 9.37 |
| Alloy 72 | 86.85 | 1.43 | 11.72 |
| Alloy 73 | 94.44 | 1.42 | 4.14 |
| Alloy 74 | 89.66 | 1.38 | 8.96 |

TABLE 5

Yield and Tensile Strengths of Alloys at 850° C. and Improvement over the baseline alloys Hastelloy ® N.

| Alloy | Yield Strength | Tensile Strength | % Improvement in Tensile Strength |
|---|---|---|---|
| Hastelloy ® N | 35.3 | 45.7 | 0 |
| Alloy 7 | 73.3 | 85.8 | 87.7 |
| Alloy 8 | 65.1 | 75.9 | 66.1 |
| Alloy 71 | 75.1 | 81.5 | 78.1 |
| Alloy 73 | 68.5 | 80.3 | 75.7 |
| Alloy 74 | 83.4 | 85.8 | 87.7 |

TABLE 6

Creep rupture lives of alloys at 850° C., at a stress of 12 Ksi and improvement over the base alloy Hastelloy ® N.

| Alloy | Creep Rupture Life (Hours) | % Improvement in Creep Rupture Life |
|---|---|---|
| Hastelloy ® N | 3.77 (average of three tests) | 0 |
| Alloy 7 | 823 | 21730% |
| Alloy 8 | 800 | 21120% |
| Alloy 71 | 751 | 19820% |
| Alloy 73 | 784 | 20696% |
| Alloy 74 | 850 | 22446% |

TABLE 7

Corrosion Rate (Weight Loss) Measured During a 1000 hour immersion in liquid FLiNaK at 850° C.

| Alloy | Weight Loss $[g/(cm^2sec)]10^{-11}$ |
|---|---|
| Hastelloy ® N | 1.21 |
| Alloy 7 | 15.50 |
| Alloy 8 | 16.75 |
| Alloy 11 | 5.80 |
| Alloy 71 | 8.48 |
| Alloy 73 | 8.77 |
| Alloy 74 | 15.26 |

TABLE 8

Composition of alloys in at. % and the calculation of the Corrosion Susceptibility Index (CSI)

| Alloy | Ni | Fe | Al | Co | Cr | Mn | Mo | Ti | Nb | Ta | Re | Ru | W | C | CSI |
|---|---|---|---|---|---|---|---|---|---|---|---|---|---|---|---|
| Hastelloy ® N | 75.35 | 4.443 | 0 | 0.157 | 7.473 | 0.594 | 10.34 | 0 | 0 | 0 | 0 | 0 | 0.02 | 0.154 | 0.08 |
| Alloy 7 | 77.656 | 0.0107 | 2.878 | 0 | 7.547 | 0.826 | 7.321 | 3.544 | 0.006429 | 0 | 0 | 0 | 0.166 | 0.144 | 0.16 |
| Alloy 8 | 78.171 | 0.0107 | 2.729 | 0 | 7.552 | 0.806 | 7.35 | 3.039 | 0.006443 | 0 | 0 | 0 | 0.182 | 0.154 | 0.15 |
| Alloy 11 | 76.653 | 0.0105 | 3.794 | 0 | 7.431 | 0.819 | 6.735 | 4.215 | 0.006369 | 0 | 0 | 0 | 0.18 | 0.158 | 0.18 |
| Alloy 71 | 77.109 | 0.01077 | 2.808 | 0 | 8.072 | 0.821 | 6.305 | 3.731 | 0.149 | 0.648 | 0 | 0 | 0.16 | 0.185 | 0.18 |
| Alloy 72 | 77.186 | 0 | 3.285 | 0 | 7.923 | 0.796 | 6.154 | 3.678 | 0 | 0.642 | 0 | 0 | 0.156 | 0.179 | 0.18 |

TABLE 8-continued

Composition of alloys in at. % and the calculation of the Corrosion Susceptibility Index (CSI)

| Alloy | Ni | Fe | Al | Co | Cr | Mn | Mo | Ti | Nb | Ta | Re | Ru | W | C | CSI |
|---|---|---|---|---|---|---|---|---|---|---|---|---|---|---|---|
| Alloy 73 | 78.02 | 0.01081 | 2.192 | 0 | 7.951 | 0.846 | 6.052 | 3.707 | 0.143 | 0.734 | 0 | 0 | 0.164 | 0.181 | 0.17 |
| Alloy 74 | 76.254 | 0 | 4.206 | 0 | 8.363 | 0.842 | 6.589 | 1.276 | 0.146 | 1.984 | 0 | 0 | 0.161 | 0.18 | 0.19 |

What is claimed is:

1. A cobalt-free Y'-strengthened alloy consisting essentially of, expressed in weight percent of the total composition:

Cr 6.3 to 7.2
Al 0.5 to 2
Fe 0 to 5
Mn 0.7 to 0.8
Mo 9 to 12.5
Ta 0 to 6
Ti 0.99 to 3.5
Nb 0.01 to 0.25
W 0.2 to 0.6
C 0.02 to 0.04
B 0 to 0.0005
N 0.0001 to 0.002
Ni balance said alloy having a Y' microstructural component in an amount of calculated weight percent of at least 3 and no more than 17.6; and said alloy being characterized by, at 850° C., a yield strength of at least 60 Ksi, a tensile strength of at least 70 Ksi, and a creep rupture life at 12 Ksi of at least 700 hours, and a corrosion rate, expressed in weight loss [g/(cm$^2$sec)] $10^{-11}$ during a 1000 hour immersion in liquid FLiNaK at 850° C., in the range of 5.5 to 17, and further characterized by a corrosion susceptibility index of no less than about 0.14 and no more than about 0.2.

2. An alloy in accordance with claim 1 wherein the range of Al is 0.75 to 2weight percent.

3. An alloy in accordance with claim 1 wherein the range of Fe is 0 to 0.05weight percent.

4. An alloy in accordance with claim 1 wherein said Y' microstructural component in an amount of a calculated weight percent of at least 3 and no more than 11.8.

5. An alloy in accordance with claim 4 wherein said Y' microstructural component in an amount of a calculated weight percent of at least 3 and no more than 9.4.

6. An alloy in accordance with claim 1 wherein said yield strength is at least 65 Ksi.

7. An alloy in accordance with claim 1 wherein said tensile strength is at least 75 Ksi.

8. An alloy in accordance with claim 1 wherein said creep rupture life is at least 750hours.

9. An alloy in accordance with claim 1 wherein said corrosion rate is no more than 8.4.

* * * * *